US008671807B2

(12) United States Patent
Monroe

(10) Patent No.: US 8,671,807 B2
(45) Date of Patent: Mar. 18, 2014

(54) EXTENSION TOOL FOR OPERATING HANDWHEELS

(76) Inventor: Thomas P. Monroe, Temple, TX (US)

( * ) Notice: Subject to any disclaimer, the term of this patent is extended or adjusted under 35 U.S.C. 154(b) by 482 days.

(21) Appl. No.: 13/025,880

(22) Filed: Feb. 11, 2011

(65) Prior Publication Data

US 2012/0204684 A1 Aug. 16, 2012

(51) Int. Cl.
*B25G 1/04* (2006.01)
*B25B 13/50* (2006.01)

(52) U.S. Cl.
USPC ..... 81/177.2; 81/176.2; 81/186

(58) Field of Classification Search
USPC ..... 81/177.1, 177.2, 177.8, 177.6, 177.4, 81/186, 176.2, 119, 120, 53.1
See application file for complete search history.

(56) References Cited

U.S. PATENT DOCUMENTS 1,287,211 A * 12/1918 Bubb ..... 81/176.2
1,511,395 A * 10/1924 Canan ..... 81/186
2,086,722 A * 7/1937 Matuella ..... 81/119
2,539,262 A * 1/1951 Moore ..... 81/119
2,674,142 A 4/1954 Angelo et al.
RE28,879 E * 6/1976 Verest ..... 81/177.2
4,715,252 A 12/1987 Pella
4,848,194 A 7/1989 Santorineos et al.
4,991,469 A 2/1991 Pella
5,469,941 A 11/1995 Horvath
5,481,950 A 1/1996 Browning
6,070,501 A 6/2000 Braun et al.
6,561,523 B1 5/2003 Wienhold
7,637,183 B2 12/2009 Alvarado
7,909,376 B1 * 3/2011 McKinley ..... 81/53.1
2010/0109357 A1 5/2010 Lofley, Sr. et al.

* cited by examiner

*Primary Examiner* — Hadi Shakeri
(74) *Attorney, Agent, or Firm* — The Culbertson Group, P.C.; Nathan H. Calvert

(57) ABSTRACT

An extension tool is provided to improve operation of handwheels, for example by allowing railroad operators to more safely reach the handbrake wheel of a train car. The tool includes a head with an upper tapered jaw designed to fit against the handwheel rim and particularly to fit the junction of the handwheel spoke and the handwheel rim circumference. The jaw may be a tapered circular rotating block. Below the jaw is a lower block designed to press against the outer circumference of the handwheel rim. The tool may also include a recess for operating a quick release lever on a train car.

8 Claims, 13 Drawing Sheets

EXTENSION TOOL FOR OPERATING HANDWHEELS

FIELD OF THE INVENTION

The present invention relates to handheld extension tools, and more particularly, to handheld extension tools for operating a handwheel associated with a hand brake on a railroad car.

BACKGROUND

This invention relates to the field of tools used in the railroad industry by trainmen, carmen, and switchmen for the application and release of the most common type of hand brakes used on freight and passenger railroad cars today. Application means to set the handbrake to the stop position where the car will not move. The word release, in this context, means to put handbrake in position where the car can be moved. This type of handbrake is called a vertical wheel handbrake. It may or may not have a quick release handle, but most do. It is usually located on the end of the railroad car at a height of about seven feet from the ground to the outside circumference or rim of the handwheel.

The application and release of handbrakes remains today to be one of the major causes of injuries to railroad employees in the operations department. The inventor hereof is a conductor with 33 years of service on the BNSF Railroad, and is aware of the long-felt need for a safer handbrake arrangement and procedure on railroad cars.

The application or release of handbrakes, in most cases, requires the employee to climb up the car side ladder and move around to the end ladder and platform to reach the handbrake. This is because the handbrake is too high off the ground for an employee of normal height to reach the handwheel and still be in compliance with the railroad safety rules.

BNSF Safety Rule S-13.6.3E relates to the application and release of handbrakes by an employee standing on the ground. Most railroads in the U.S., and many abroad, have a similar rule. The rule reads as follows:

S-13.6.3 Position to Operate

A. End-Mounted with Brake Steps or Crossover Platform

If the car has end-mounted brakes and a brake step or crossover platform:

1. Stand on the brake step or crossover platform to operate hand brakes.
2. Apply hand brakes by standing on the left side of the brake with your left foot on the ladderrung and your right foot on the brake platform.
3. Grasp the ladder rung or top handhold with your left hand and operate the brake with your right hand.

B. Side-Mounted

Operate side-mounted hand brakes from the ground if the brake mechanism is within easy reach and you can safely operate it without straining too much and risking injury.

C. End-Mounted without Brake Steps or Crossover Platform

If the car has end-mounted hand brakes without brake steps or crossover platforms:

Do not operate the hand brakes from the ground unless proper safeguards are provided, such as blue signal protection.

To operate the hand brakes, stand on the car or on the ground at the side of the car.

D. Horizontal Wheel or End-Mounted, Inward Facing

Stand on the car to operate horizontal wheel (staff) hand brakes and end-mounted, inward facing hand brakes.

E. Vertical wheel hand brakes may be operated without getting on the railcar if:

1. The car remains stationary.
2. Both feet remain flat on the ground and outside the rail.
3. Elbows are slightly bent during operation.
4. One hand can hold onto the grab iron while the other hand is used to operate the brake wheel.

The handwheel of the handbrake is manufactured from flat steel, press-formed into shape, with the outside wheel rim and spokes formed into a semicircular 'C' shape, as shown in cross section in FIGS. 7A and B. The handwheel shaft is connected to a small gear inside the brake housing, which turns a larger gear that the handbrake chain wraps around when it is applied. The handbrake also has a locking mechanism that maintains the brake in the applied position. Almost all vertical wheel handbrakes are equipped with a quick release handle that releases the brake without requiring use of the handwheel. However, the handbrake can only be applied with the handwheel.

The handbrake chain is connected from the brake to the air brake appliances that apply and release the brakes on the car. When not applied, the handbrake chain must remain loose so that the air brakes properly apply and release as needed.

Extension handles are used in some industries to allow operation of valves with increased leverage. For example, U.S. Pat. No. 4,848,194, issued to Santorineos describes a valve tool and adjustable wrench combination tool used to operate large cutoff valves. These cutoff valves also have a circular handwheel with a shaft connected to the valve body. The handwheel in this instance is round, instead of C shaped like the handwheels on typical railroad cars. The Santorineos extension tool used on the wheel has two jaws of the same basic shape and the same height. Santorineos teaches that the tool is intended and designed to be used on the valve handwheel centered on the rim between two spokes. Such a design and method would have several serious problems that would arise if, hypothetically, it were attempted to be used as an effective handbrake application and release tool. First, it does not have any feature that would allow it to operate a quick release handle. It also cannot be used at the junction between the inside handwheel rim or circumference and the spoke of the handwheel. This is an important element when dealing with railroad handbrakes because of the aforementioned slack present in the brake chain when the brake is not applied. Further, most operations employees do not regularly carry an adjustable wrench in the course of their normal duties, nor is such a wrench part of the normal set of tools kept on the engine of a train. A handbrake tool needs to provide ability to adjust the angle between the tool head and the handle as needed for the different operations of applying and releasing the train handbrakes. Also, vertical handbrakes are almost always operated in a vertical overhead position with one hand. Given such position, the Santorineos tool would not function as a practical and effective railroad handbrake extension tool.

U.S. Publication No. 2010/0109357 by Lofley discloses an extension tool with a telescoping handle. The tool includes a spring-biased switch, and an inner handle section that slides relative to an outer handle section. A spring-biased switch may be depressed to move the inner handle section relative to the outer handle section. When the switch is released, the inner handle section is locked in place with respect to the outer handle section. The tool features a hooked end that may be used to engage a handwheel on a rail car. However, even in its collapsed state, the length of the tool in Lofley's disclosure would make it highly cumbersome for employees to carry on their person. In fact, Lofley teaches storing the tool in a specialized elongated channel in a railroad car. Adding such a channel to a railroad car to accommodate the tool, and removing and replacing the tool after each use, could prove costly and inconvenient. In addition, Lofley's tool would not allow a handwheel to spin freely, because the shape of the hook on the tool would interfere with the handwheel's motion. The Lofley tool also provides no way of operating a quick-release lever on a handbrake. As a result, Lofley's tool would require a user to spend an undesirable amount of time rotating the handwheel.

SUMMARY OF THE INVENTION

An extension tool is provided to allow operators on a railroad to more safely reach the handbrake wheel of a train car. The tool includes a head with an upper tapered jaw designed to fit against the handwheel rim and particularly to fit the junction of the handwheel spoke and the handwheel rim circumference. The jaw may also be a tapered circular rotating block. Below the upper jaw is a lower jaw or block designed to press against the outer circumference of the handwheel rim. The lower block also extends from the front side of the central body along the lower end; however, the lower block extends a shorter distance from the front side than does the upper block, so as to provide a clearance for a moving handwheel operated with the tool.

One purpose of this invention is to provide, for use with railroad cars, a multipurpose extension tool with a head operable at the junction of the inner handwheel rim and a joining rim of a handwheel's spoke. The tool provided has an upper jaw that will fit between the junction of the inner handwheel rim and a joining rim of a handwheel's spoke. Opposite the upper jaw is a lower jaw adapted to securely fit the outside rim of the handbrake handwheel. This provides a safe and secure means of operating the handwheel to apply and release handbrakes.

Another embodiment provides an extension tool for operating handbrake wheels with a tool head having an upper jaw that is matched to fit the contour between the junction of the inner handwheel rim and a joining rim of one handwheel spoke. Opposite the upper jaw is a lower jaw which is shorter than the upper jaw. The upper jaw is adapted to be placed at the junction of the inner handwheel rim and the joining rim of the handwheel spoke when the tool head is held at an angle down and away from the handbrake handwheel. The tool is operable such that, with a quick pull down and away from the handbrake, the handwheel will spin freely, thereby removing free slack in the chain. Because of the difference in the lower jaw length and upper jaw length, the handwheel rim will not interfere with the lower jaw as it passes while spinning Some embodiments of the invention provide an extension tool for use with railroad cars, where the extension tool has a toolhead that is adjustable at different angles to the handle. This allows operations personnel to use the tool in compliance with safety rules, even if the handbrake is mounted in a location that would otherwise have been too high to properly operate.

Other embodiments of the invention provide an extension tool, for use with railroad cars, that is adapted to safely and properly operate the car's handbrake quick release handle. This is accomplished by providing two semicircular raised rocker blocks on the back of the extension tool head, opposite the handwheel jaws. In one version, the rocker blocks may be embodied as quick-release handle forks. The tool head back side also has a raised end handle stop block. A cover place is provided over the two rocker blocks to keep the tool from slipping off of the quick release handle. In operation, the tool head is placed over the end of the handle, with the handle between the rocker blocks. The extension tool may then be used to raise the handle to the release position. The extension tool handle will typically be angled down from the tool head, such that in the released position the tool handle does not exceed the operator's ability to easily reach it.

In another embodiment, the invention provides for railroad use, a multipurpose tool head with an upper tapered circular rotating block that will securely fit between the junction of the inner handwheel rim and a joining rim of one hand wheel spoke. The rotating block will closely match the contour between the spoke and the inner handwheel rim circumference. Further, the invention provides for railroad use the multipurpose tool head with a lower block shorter than the upper tapered circular rotating block. Such a difference in length allows the tool head to be used to quickly remove the slack in the handbrake chain.

Further, the invention provides for railroad use a multipurpose tool head where the relationship between the tool head and the handle may be changed to allow any person to perform all the operations needed in applying and releasing handbrakes. Such a design further allows operations personnel to comply with safety rules such as BNSF rule S.13.6.3E, discussed above.

DETAILED DESCRIPTION OF PREFERRED EMBODIMENTS

Figure 1:
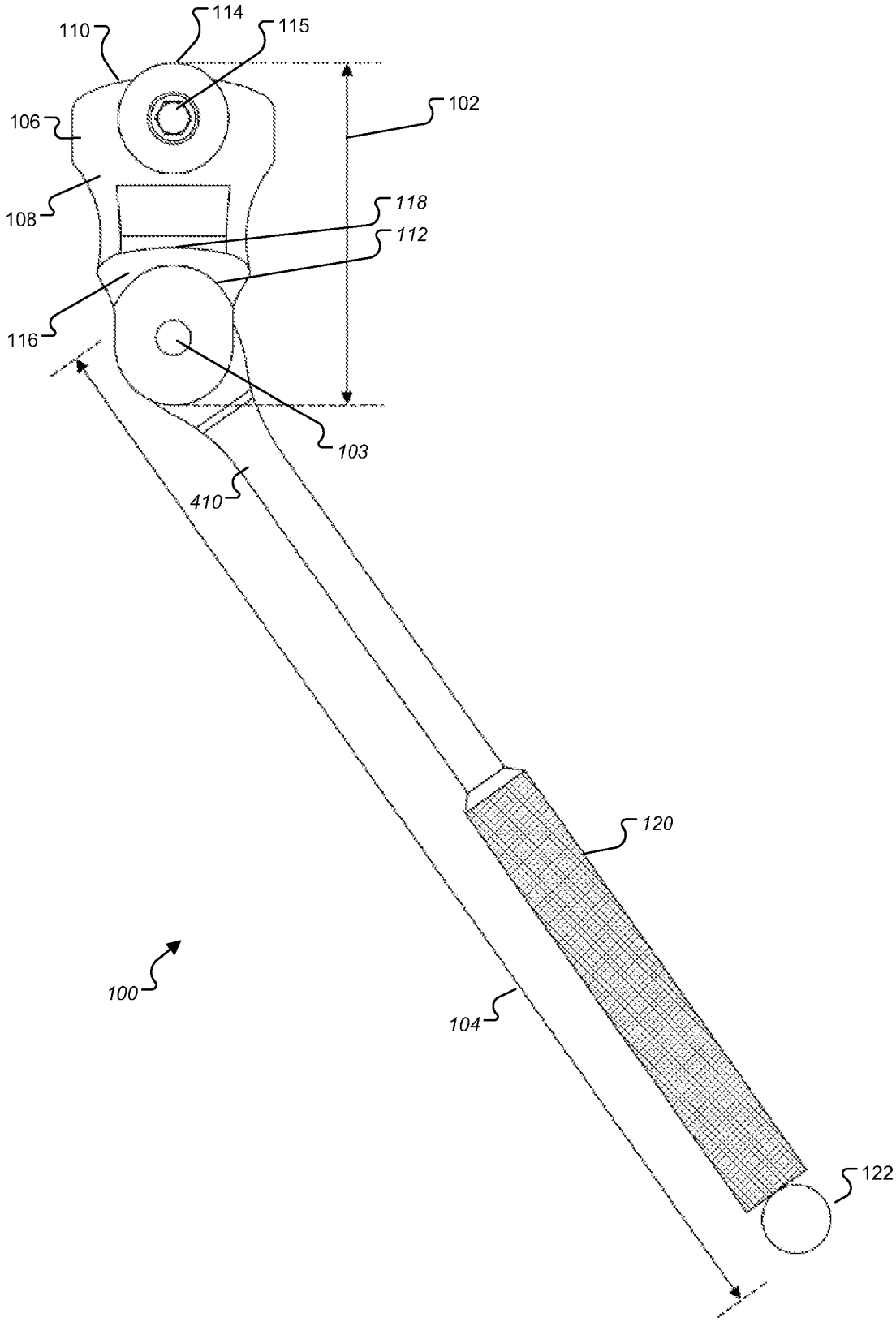
FIG. 1 is a front view of an extension tool according to embodiment of the invention.
Figure 2:
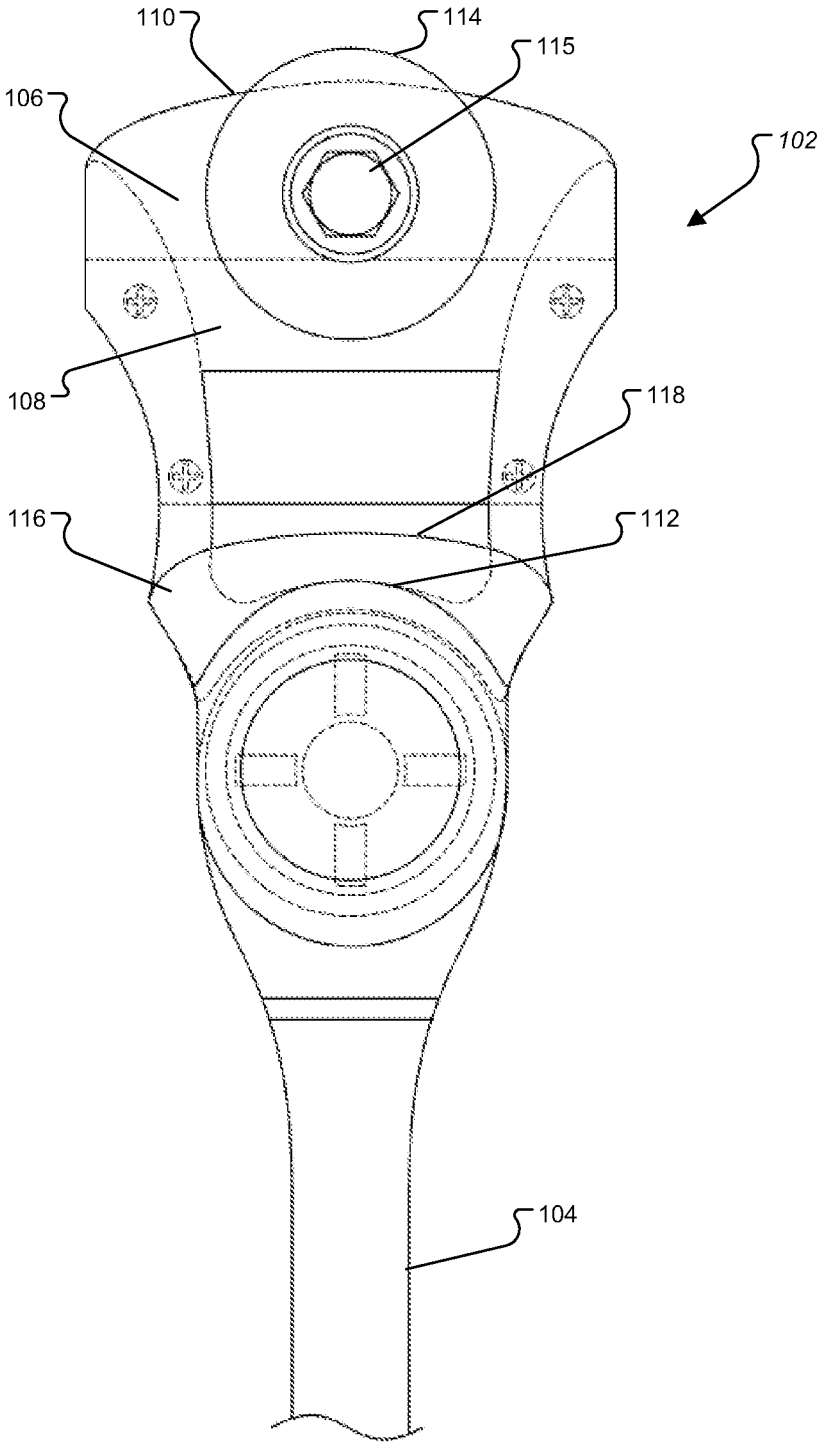
FIG. 2 is an enlarged front view of the head portion of the tool in FIG. 1.

FIG. 1 is a front view of an extension tool 100 according to one embodiment of the invention. The depicted tool is employed as an extension tool to help operators reach the handbrake wheel of a train car. FIG. 2 is a close-up view of the head portion of tool 100; the details of the head portion may be better seen with respect to FIG. 2.

The tool 100 comprises a tool head 102, a connecting assembly 103, anal, a handle 104. Tool head 102 is removably attached to handle 104 by means of connecting assembly 103. The features of each part are explained in greater detail below.

With regard to FIGS. 1 and 2, tool head 102 further comprises a central body 106 with a front side 108, an upper surface 110, and a lower surface 112. A upper tapered circular rotating block 114 extends from the front side 108 of central body 106. Rotating block 114 is affixed to central body 106 by means of a rotating block fastener 115. Rotating block fastener 115 is installed so that the axis along its length is substantially perpendicular to front side 108. Rotating block 114 freely rotates around the axis defined by rotating block fastener 115. The rotating block 114 has a first smaller thickness toward the central body and gradually expands to a second larger thickness away from central body 106. Rotating block 114 is adapted to fit along both the outward facing curved surface of a handwheel rim on a railroad car and along a joint of the handwheel rim and a spoke of a handbrake wheel, as the following drawings will show in more detail.

A lower jaw 116 also extends from the front side 108 of central body 106, but lower jaw 116 extends a shorter distance from front side 108 than does upper tapered circular rotating block 114. Lower jaw 116 comprises an upper curved surface 118 that is curved upwardly with respect to a lower end of the tool head. The difference in the distance that lower jaw 116 and rotating block 114 extend from central body 106, as well as the curvature of the upper surface, allows a user to selectively apply lower jaw 116 to the handbrake wheel as needed. The significance of these features is explained in greater detail in FIGS. 7 and 13.

Tool head 102 is removably attached to handle 104 by means of connecting assembly 103. Connecting assembly 103 allows a user to removably fix a relative angle between tool head 102 and handle 104. Connecting assembly 103 is shown in greater detail in FIGS. 5-6.

Handle 104 comprises a textured grip portion 120 and a removable tightening tool 122. The textured grip portion 120 creates a high degree of friction between the handle and a user's hand, preventing the handle from slipping during use. The removable tightening tool 122 allows a user to secure a desired angle between the tool head and the handle.

The rotating block 114 is a specific embodiment of an upper jaw. More generally, the present invention has an upper jaw extending from the front side of the central body along the upper end. The upper jaw has a curved lower surface and a graduated lip formed along the curved lower surface. The graduated lip has a first smaller thickness toward the central body and gradually expanding to a second larger thickness away from the central body, and is adapted to fit along the rim of a handwheel on a railroad car.

Preferably, tool 100 is constructed from machined metal, such as steel or aluminum. However, other materials may also be used to manufacture tool 100. The handle 104 and the central body 106 are typically each constructed from a single piece of material; however, they may also each be constructed of multiple pieces of material. The tool may also be constructed of a compound of injection molded or synthetic material. Preferably, tool head 102 is constructed to be approximately 5⅜" in length, and tool handle 104 is constructed to be approximately 18 inches in length.

Figure 3:
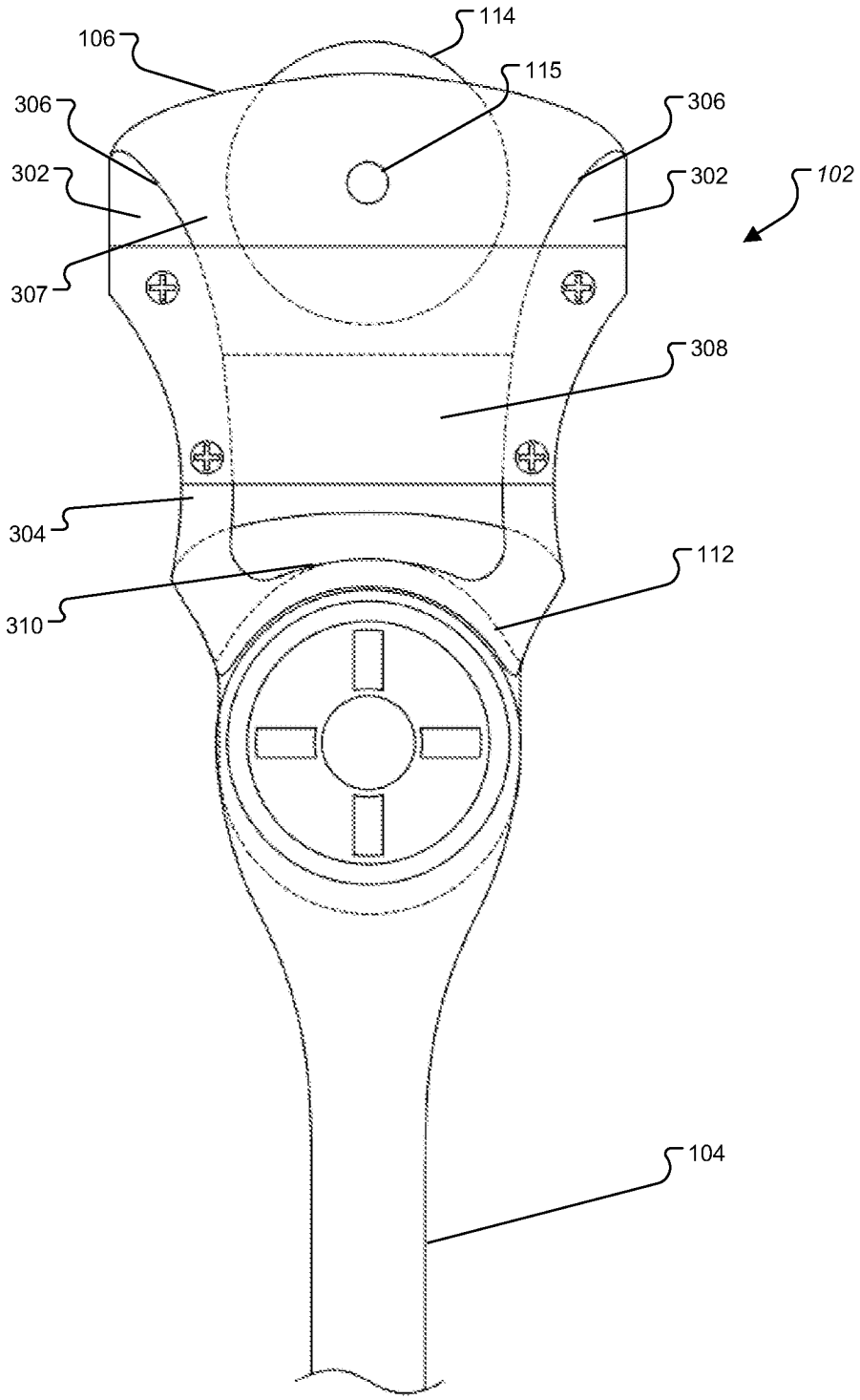
FIG. 3 is an enlarged rear view of the head portion of the tool in FIG. 1.

FIG. 3 is an enlarged rear view of the tool head 102 in FIG. 1. FIG. 3 shows two quick release forks 302 that extend from the central body 106 to a back side 304 of tool head 102. Each of the quick release forks features a curved surface 306. The two curved surfaces 306 define a gap along a width of tool head 102. The curved surfaces 306 flare outward with respect to the width of tool head 102 so that the gap defined by the two curved surfaces 306 is widest at the upper surface of central body 106, and narrowest at the lower surface of central body 106. A fork containment plate 308 is affixed to the quick release forks 302 at back side 304. A quick release handle stop block 310 protrudes from lower surface 112. Although quick release forks are shown in the embodiments herein, other versions may use any suitable block structure such as rocker blocks in place of the depicted quick release forks 302.

The width gap between curved surfaces 306, along with the depth offset between quick release forks 302 and central body 106, forms a recess adapted to accommodate a quick release lever associated with a handbrake of a train car. The curved surfaces 306 define side boundaries of the recess, and the front of fork containment plate 308 defines a rear boundary of the recess. A surface of central body 106 defines an inside recess wall 307, which acts as a front boundary of the recess. The thickness of the recess is equal to the distance between quick release forks 302 and central body 106. Preferably, this distance is approximately 11/16". The recess allows tool 100 to be used as an extension tool for quickly and easily operating a quick release lever. This feature is described in greater detail with respect to FIGS. 9 and 14.

Figure 4:
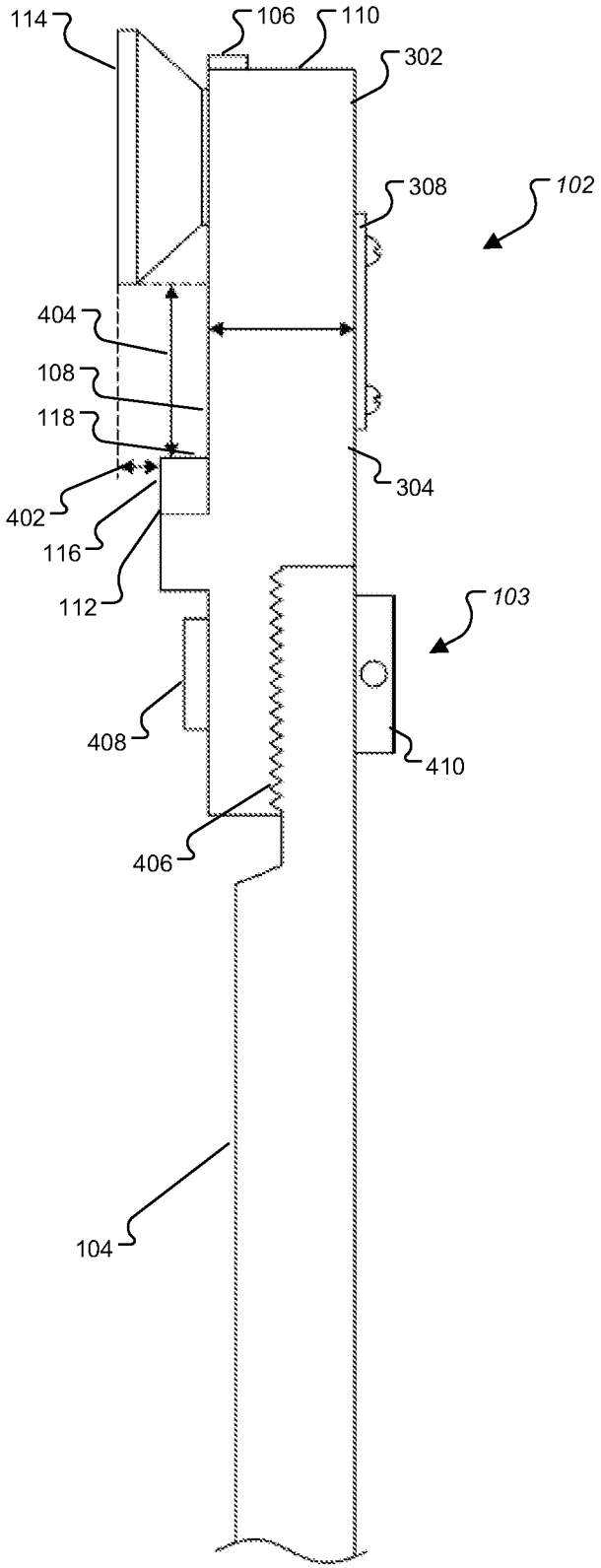
FIG. 4 is a side view of the head portion of the tool in FIG. 1.

FIG. 4 is a side view of the head portion of the tool in FIG. 1. In FIG. 4, it may be seen that tool head 102 has several important dimensions, including a jaw thickness offset 402 and a jaw height offset 404. The jaw thickness offset is defined as the distance that rotating block 114 extends from front side 108 minus the distance that lower jaw 116 extends from front side 108. Preferably, the jaw thickness offset 402 is between ⅝" and ¾", and more preferably, jaw thickness offset 402 is approximately ⅝". It should be noted that because the rotating block 114 always extends further from front side 108 than does lower jaw 116, the jaw thickness offset will always be a positive number.

The jaw height offset 402 is defined as the smallest vertical distance between rotating block 114 and lower jaw 116. The gap between rotating block 114 and lower jaw 116 must be able to accommodate the rim of a handbrake wheel with about ¼" clearance between the lower jaw and the handwheel, as shown in FIG. 7. However, the gap should remain large enough for a user to easily attach or detach the tool head 102 to the handwheel. Thus, the jaw height offset 402 is equal to the sum of the diameter of a typical handbrake wheel rim and a desired clearance distance. Preferably, the jaw height offset 402 is between 1⅛" and 1⅜", and more preferably, the jaw height offset 402 is approximately 1 3/16".

FIG. 4 shows in greater detail how tool head 102 and handle 104 may be removably secured so as to form a desired angle between tool head 102 and handle 104. Tool head 102 and handle 104 each has a plurality of serrated teeth 406. The serrated teeth 406 on tool head 102 are adapted to fit complementarily to the serrated teeth 406 on handle 104. When the serrated teeth 406 are pressed together, they fit into each other so as to prevent relative rotational movement between tool head 102 and handle 104.

Connecting assembly 103 comprises a t-nut 408 and a bolt 410. When connecting assembly 103 is in an operating condition, the t-nut 408 engages bolt 410 so as to press tool head 102 and handle 104 together. Thus, when a user wishes to secure a desired angle between tool head 102 and handle 104, he can do so by simply fitting the tool head 102 and handle 104 together at the desired angle, meshing their respective serrated teeth 406 together. The user then tightens bolt 410 to press tool head 102 against handle 104, causing serrated teeth 406 to prevent tool head 102 and handle 104 from rotating relative to each other.

Figure 5:
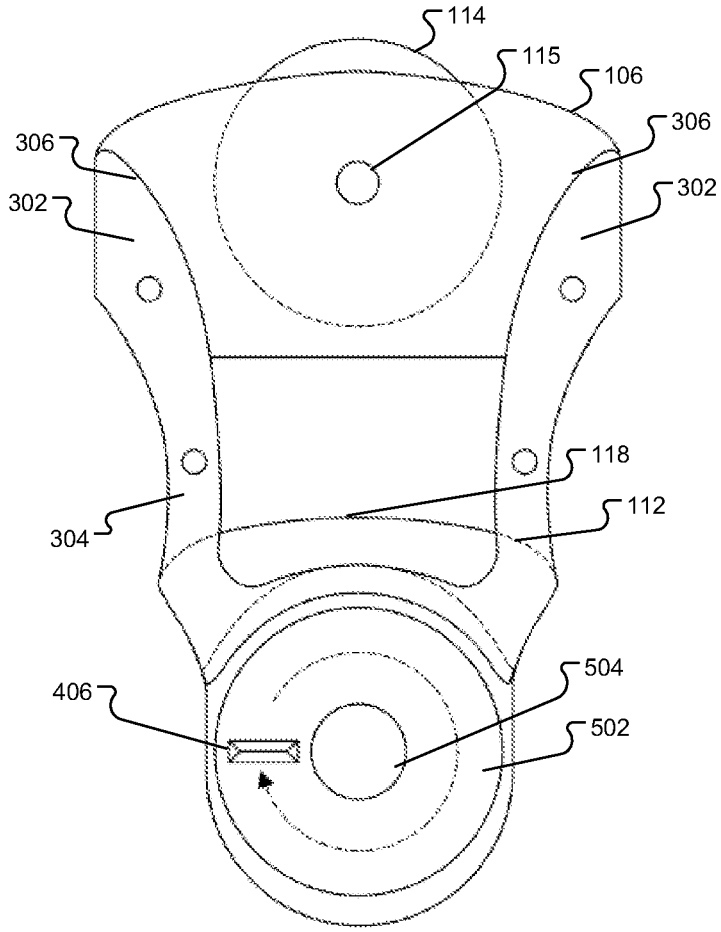
FIG. 5 is a rear view of the tool head with a portion removed from the handle portion.

FIG. 5 provides another view of the serrated teeth 406 on the tool head 102. In this view, it may be seen that tool head 102 has a serrated surface 502, which consists of a number of serrated teeth 406 arranged in a ring formation along a flat surface. The serrated surface 502 on the tool is pressed against a complementary serrated surface on handle 104 (not shown in this view). The serrated teeth on handle 104 and tool head 102 mesh, preventing rotational movement between tool head 102 and handle 104 and thus fixing the relative angle between tool head 102 and handle 104.

The cutaway view of FIG. 5 also shows an opening 504 in a lower area of tool head 102. Opening 504 is adapted to accommodate connecting assembly 103. Handle 104 (not shown in this view) has a corresponding opening 504 adapted so that when tool head 102 is attached to handle 104, the opening 504 on tool head 102 aligns with the opening 504 on handle 104. When the openings 504 on tool head 102 and handle 104 are aligned, there is a continuous hole through the combined thickness of tool head 102 and handle 104, allowing connecting assembly 103 to continuously pass through tool head 102 and handle 104.

Figure 6:
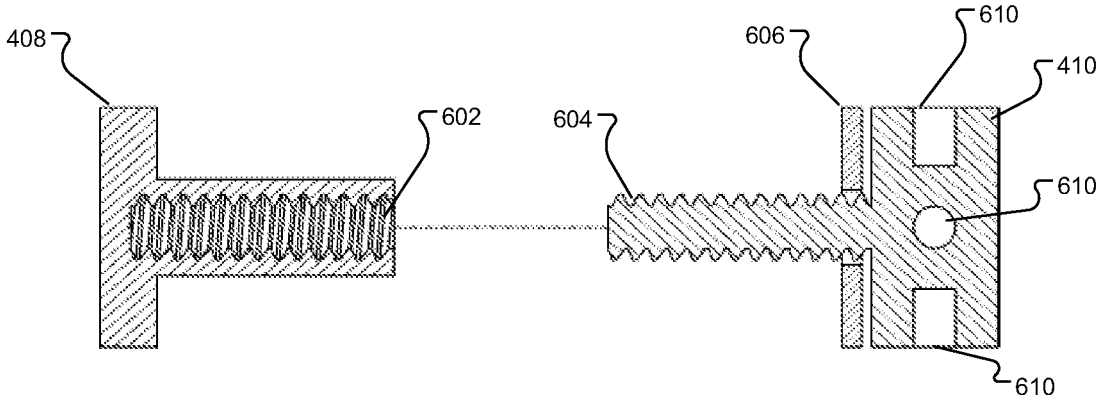
FIG. 6 is a cross sectional view of a bolt joining the tool head to the handle in one embodiment.

FIG. 6 illustrates how connecting assembly 103 joins the tool head 102 to the handle 104. T-nut 408 protrudes rearward from a front side 108 of tool head 102 through opening 504. When connecting assembly 103 is fully tightened, bolt 410 protrudes forward from a rear surface of handle 104, the rear surface being flush with back side 304 of tool head 102. A helical recess 602 in t-nut 408 accommodates a helical thread 604 on bolt 410, allowing bolt 410 to be screwed into t-nut 408. Optionally, a washer 606 may be placed between bolt 410 and handle 104 to prevent damage to handle 104 if a high amount of torque is applied to bolt 410.

The bolt 410 may further include one or more tightening recesses 610 that accommodate the tightening toot 122 stored in handle 104. When a user wishes to tighten connecting assembly 103 to join tool head 102 and handle 104, he removes tightening tool 122 from handle 104, inserts tightening tool 122 in one of tightening recesses 610, and applies torque to the bolt 410 via the tightening tool 122. This causes connecting assembly 103 to exert force on tool head 102 and handle 104, biasing them together and fixing their relative angle.

Figure 7B:
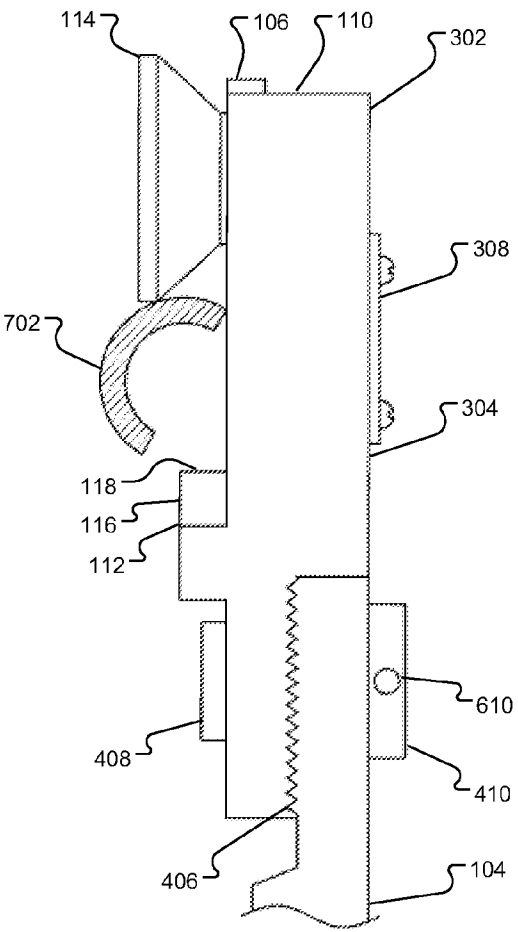
FIG. 7B is a similar view to that in FIG. 7A, showing the tool a second position occurring during operation of the handwheel.
Figure 7A:
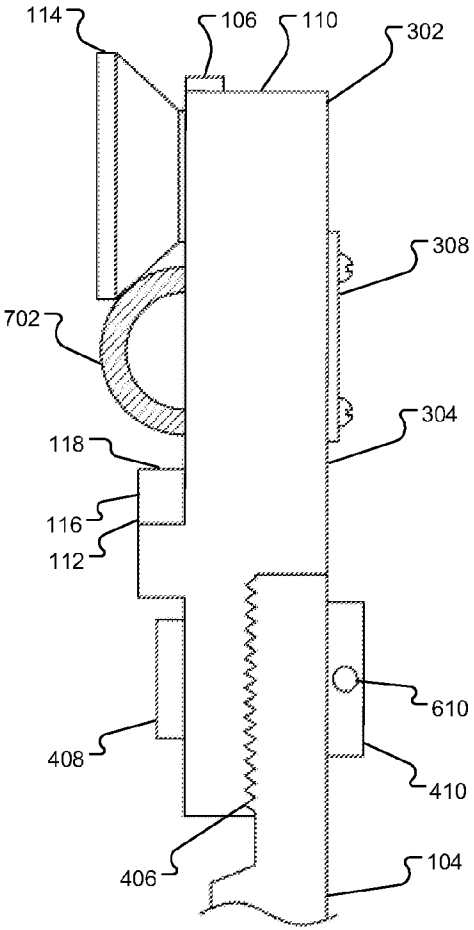
FIG. 7A is a side view of the tool head positioned in use with the cross section of the handwheel rim visible interacting with the head of the tool.

FIGS. 7A and 7B show two different positions in which the tool 100 may be used on a handwheel rim according to the present invention. FIG. 7A shows the tool head 102 positioned in use so that the vertical plane of the tool head 1.02 is in the same vertical plane as a handwheel. In this position, both the rotating block 114 and the upper surface 118 of the lower jaw 116 engage handwheel rim 702 so that the tool 100 fits tightly onto handwheel rim 702. This engagement by both rotating block 114 and upper surface 118 allows a user to apply a high degree of force to maximally tighten a handwheel.

In order to ensure that the handwheel rim 702 fits properly between rotating block 114 and upper surface 118, the jaw height offset 404 is preferably slightly larger than a diameter of the handwheel rim 702. The difference in distance between jaw height offset 404 and the diameter of the handwheel rim 702 is sufficiently large so that a user may easily attach and remove tool head 102 from handwheel rim 702, and preferably about ¼". However, jaw height offset 404 must also be sufficiently small so that when a user rotates the tool head 102, the curvature of upper surface 118 comes into direct contact with the handwheel rim 702.

FIG. 7B shows the tool head 102 positioned in use so that the vertical plane of the tool head 102 is angularly offset from the vertical plane of the handwheel. In this position, only the rotating block 114 engages the handwheel. The upper surface 118 of the lower jaw 116 does not make contact with the handwheel. In this position, a user can grab a handwheel using tool 100 and apply moderate force to make the handwheel spin freely. The jaw thickness offset 402 is sufficient so that when a user spins the handwheel, the lower jaw 116 does not interfere with the movement of the handwheel. The depicted head therefore allows the wheel to spin freely while the tool head is still in the depicted engaged position. After that, the wheel may be tightened by applying lever force to the wheel by tilting the tool head 102 and contacting the upper surface 118 of lower jaw 116 to the wheel. Upper surface 118 is, in the preferred embodiment, curved so as not to damage the wheel when such pressure is applied.

Figure 8:
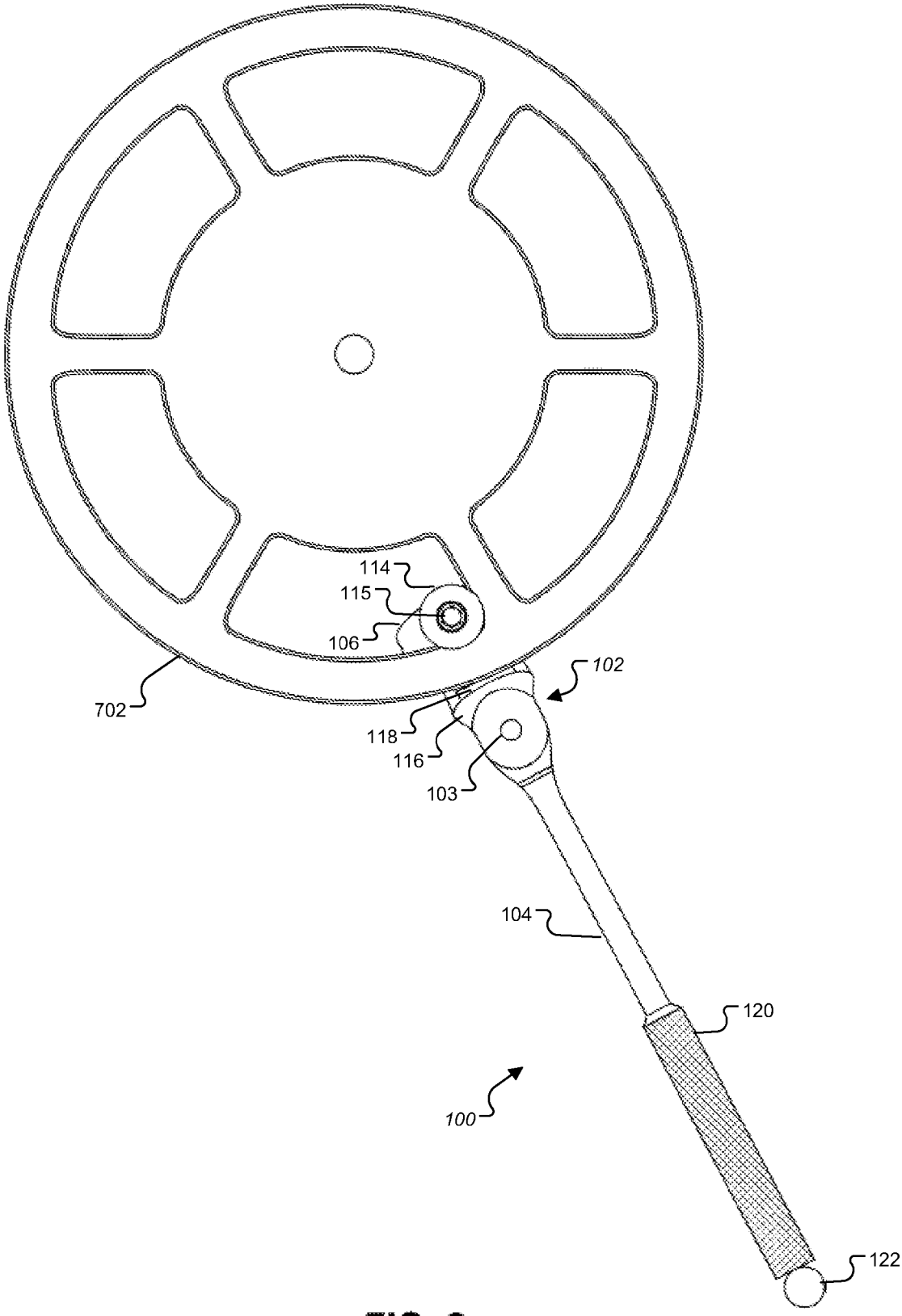
FIG. 8 is a view of the extension tool in operation used on a handwheel, from a perspective up and behind the handwheel facing outward from the wall of the train car.

FIG. 8 is an alternate view of the tool head 102 in the same position shown in FIG. 7A. In this view, the tool fits along both the outward facing curved surface of a handwheel rim and along a joint of the handwheel rim and a spoke of a handbrake wheel. The curvature of the rotating block 114 closely matches the contour between the spoke and the interior of the handwheel rim. This curvature allows the tool 100 to be easily and effectively fit to the handwheel.

Figure 9:
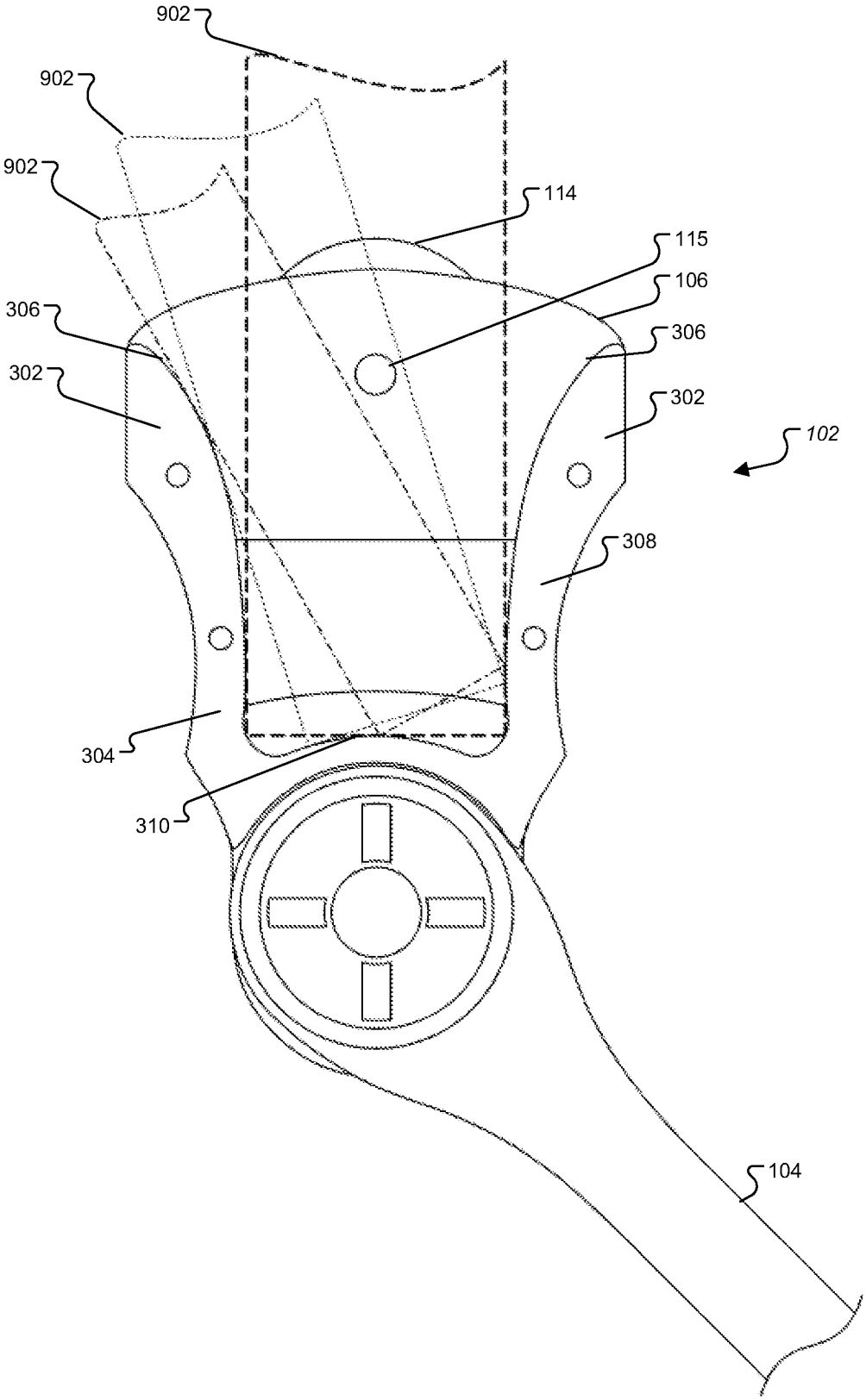
FIG. 9 is a view of the tool head from the rear, showing three different outlines of a quick release handle as they fit into the quick release forks on the rear of the tool head.

FIG. 9 illustrates how the quick release forks 302 on the rear of the tool head 102 effectively accommodate quick release levers of varying sizes. The curved surfaces 306 of quick release forks 302 create a gap that accommodates a quick release lever 902. The gap is widest at the upper surface 110 of central body 106 (FIG. 2), and narrowest at the lower surface 112 of central body 106. As a result of this curvature, an operator can use the tool to operate relatively small levers by fitting the tool at an angle to the quick release lever 902 and applying force. In the case of larger levers, such as those having a width equal to the narrowest part of the gap between the curved surfaces 306, a user would need to fit the tool so that the vertical axis of the tool head is substantially parallel to the length of quick release lever 902. In embodiments of the invention having a fork containment plate 308, the fork containment plate 308 prevents the lever from moving beyond back side 304 and slipping out of the gap between the curved surfaces 306.

Figure 10A:
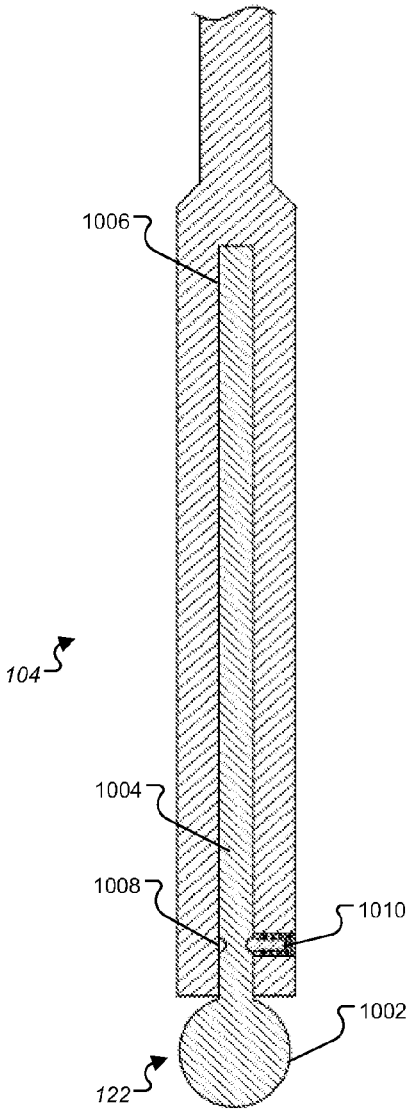
FIGS. 10A-B are cross section views of a handle according to one embodiment, having a removable tool for adjusting the tool head.

As can be seen with respect to FIG. 10A, a removable tightening tool 122 may be stored in handle 104. Tightening tool 122 consists of a tightening tool handle 1002 and an elongated rod 1004. While the tightening tool 122 is stored in handle 104, the elongated rod 1004 remains inside an elongated tightening tool recess 1006 along the length of handle 104. A notch 1008 on elongated rod 1004 is adapted to accommodate a spring-biased stop 1010, which exerts a biasing force on elongated rod 1004 so that elongated rod 1004 remains inside tightening tool recess 1006.

Figure 10B:
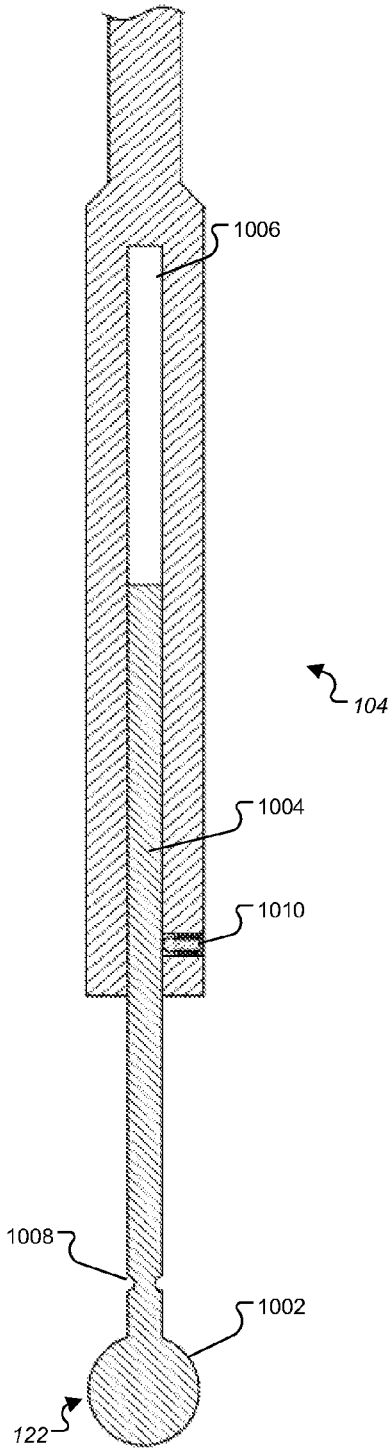

As shown in FIG. 10B, if a user wishes to remove the tightening tool 122 from handle 104, he can simply pull on tightening tool handle 1002 with enough force to overcome the biasing force of spring-biased stop 1010. The user can then use tightening tool 122 to loosen or tighten connecting assembly 103, in order to respectively fix or unfix the angle between tool head 102 and handle 104. To tighten connecting assembly 103, a user should fit the end of elongated rod 1004 into one of tightening recesses 610 of bolt 410. Then, the user should apply torque to bolt 410 by applying force to the handle 104 of tightening tool 122. Depending on the direction in which bolt 410 is turned, the force that connecting assembly 103 exerts on tool head 102 and handle 104 will either increase or decrease.

Figure 11C:
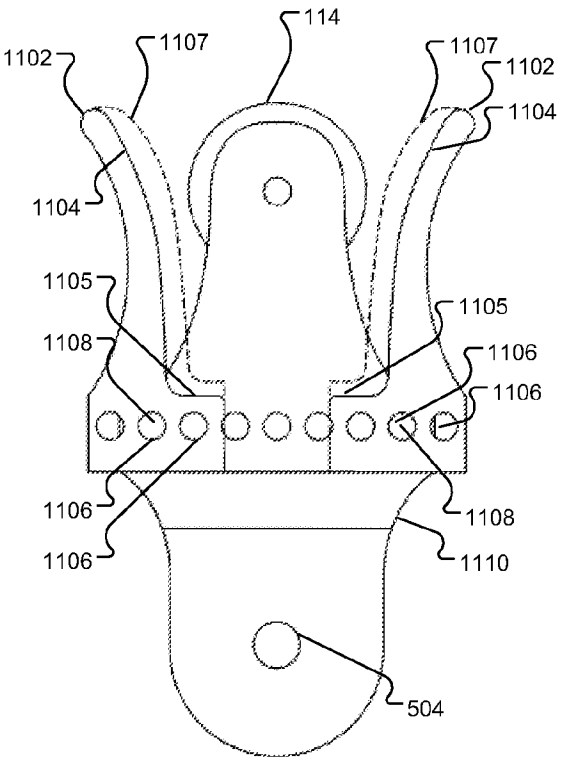
FIGS. 11A-C are rear views of a tool head according to another embodiment in which the quick release forks are repositionable on the rear of the tool head. The three different views show the forks in three different positions.
Figure 11B:
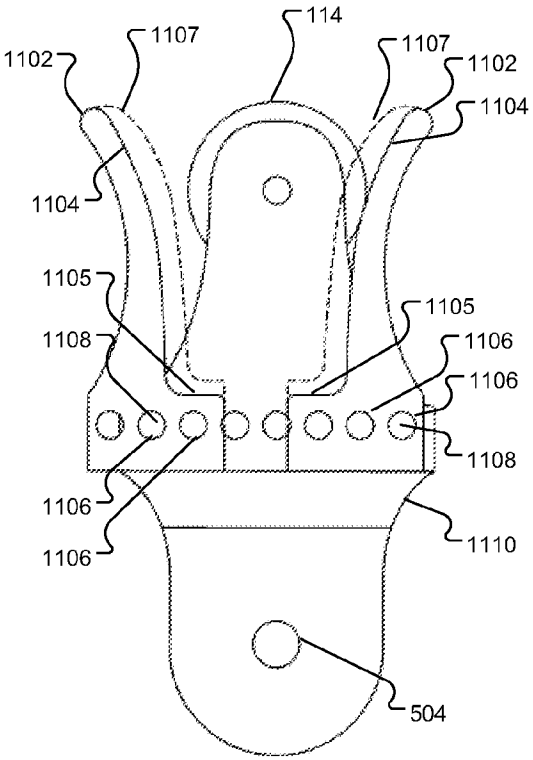
Figure 11A:
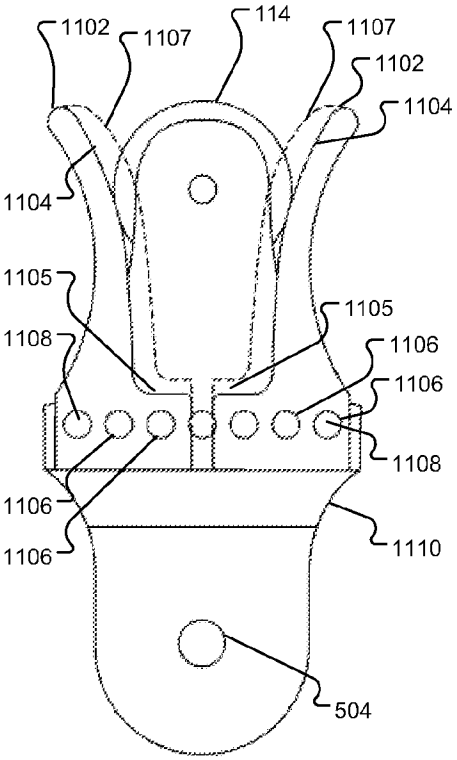

FIGS. 11A-C are rear views of a tool head according to another embodiment in which the quick release forks are repositionable on the rear of the tool head. The three different views show the forks in three different positions. These repositionable forks help eliminate lost motion that may be present using the toolhead of the previous embodiment because of the unchangeable width in the forks as it matches to different quick release handle widths. The depicted embodiment has two quick release forks 1102 formed from separate blocks. In this embodiment, each quick release fork 1102 is removable from the tool head and adjustable with respect to a width of the tool head. Each quick release fork 1102 includes a curved surface 1104, the curved surfaces 1104 adapted so that a gap formed between the two curved surfaces accommodates a quick release lever at a plurality of angles between the tool head and the quick release lever. Each quick release fork 1102 further includes a stop block surface 1105, adapted to stop a quick release lever by contacting its end, and a fork containment plate 1107. Each quick release fork 1102 further includes one or more peg holes 1106. Peg holes 1106 are adapted so that quick release forks 1102 can be attached to at least one of a plurality of horizontally arranged pegs 1108 that extend rearward from central body 106 of tool head 102 (FIG. 2). A ledge 1110 extending rearward from central body 106 provides vertical support to each quick release fork 1102.

The relative arrangement of quick release forks 1102 can be easily changed by removing quick release forks 1102 from their respective pegs 1108 and placing quick release forks 1102 on a different set of pegs 1108. Thus, the quick release forks 1102 are horizontally repositionable in this embodiment. As shown in FIGS. 11A-11C, an operator can flexibly alter the size of the gap between quick release forks 1102 to accommodate quick release levers of varying sizes. For example, in FIG. 11C, the gap between quick release forks 1102 has been made larger than that in 11A, allowing the quick release forks 1102 in FIG. 11C to accommodate wider quick release levers. As shown in FIG. 11B, quick release forks 1102 do not necessarily need to be symmetrically arranged around a vertical centerline of tool head 102. As a result, an operator may prefer to arrange quick release forks 1102 asymmetrically for ergonomic or other reasons.

Figure 12:
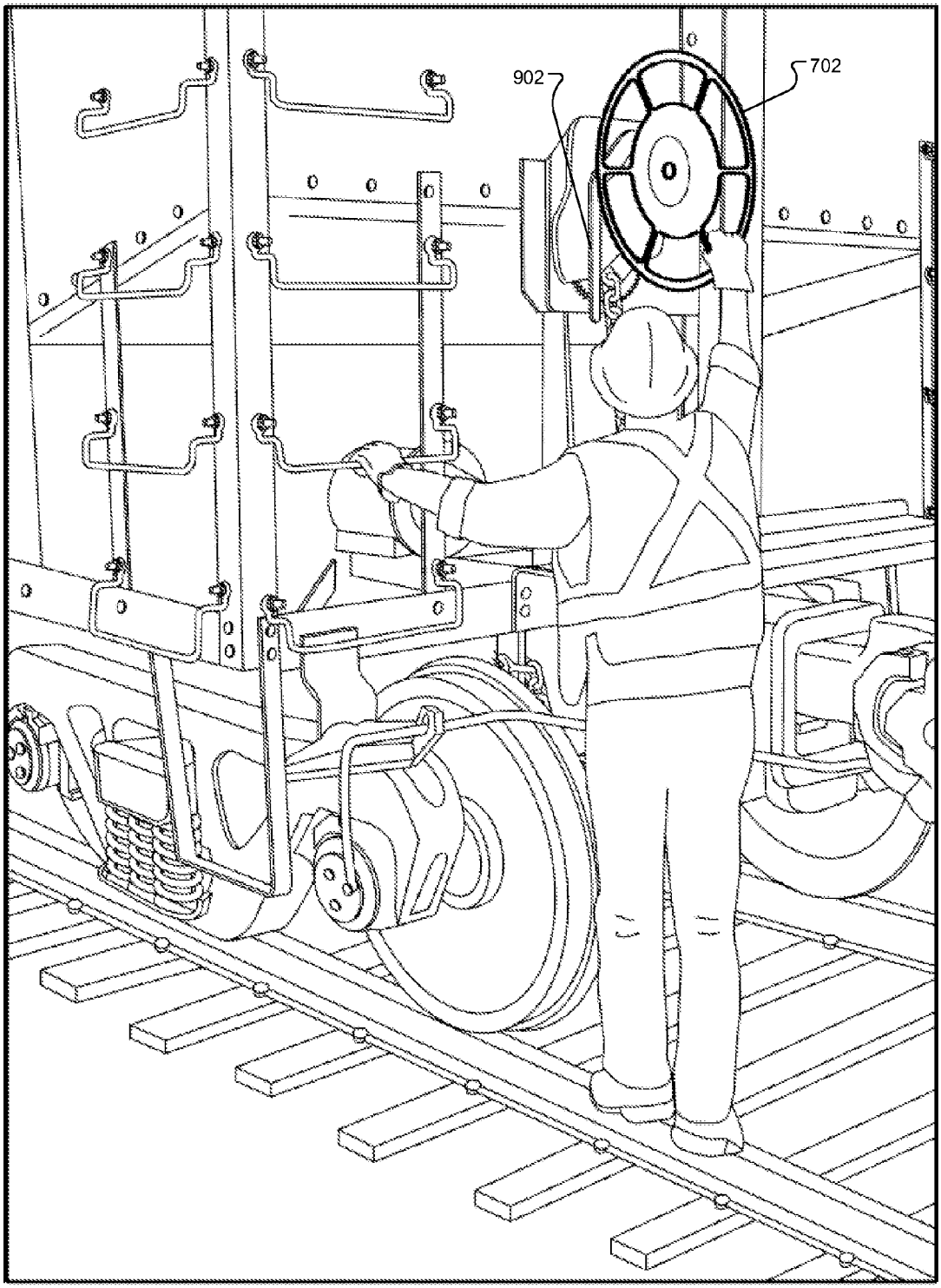
FIG. 12 is a perspective view of the rear of a train car showing an operator turning the handbrake wheel from an unsafe position, which violates typical safety rules.

FIG. 12 shows an unsafe and unwieldy method of operating a train car handbrake by hand. As noted above, railroad safety considerations require that if a handbrake operator is standing on the ground, he should stand outside the rails to turn the handwheel associated with the handbrake. However, many operators cannot reach the handwheel from outside the rails, so they may violate safety rules by turning the handwheel while standing on or inside the rails. In addition, turning the handwheel by hand is unwieldy and inconvenient, as many operators cannot reach the handwheel from the ground. In such cases, operators must climb onto an elevated platform on the train car to operate the handwheel.

Figure 13:
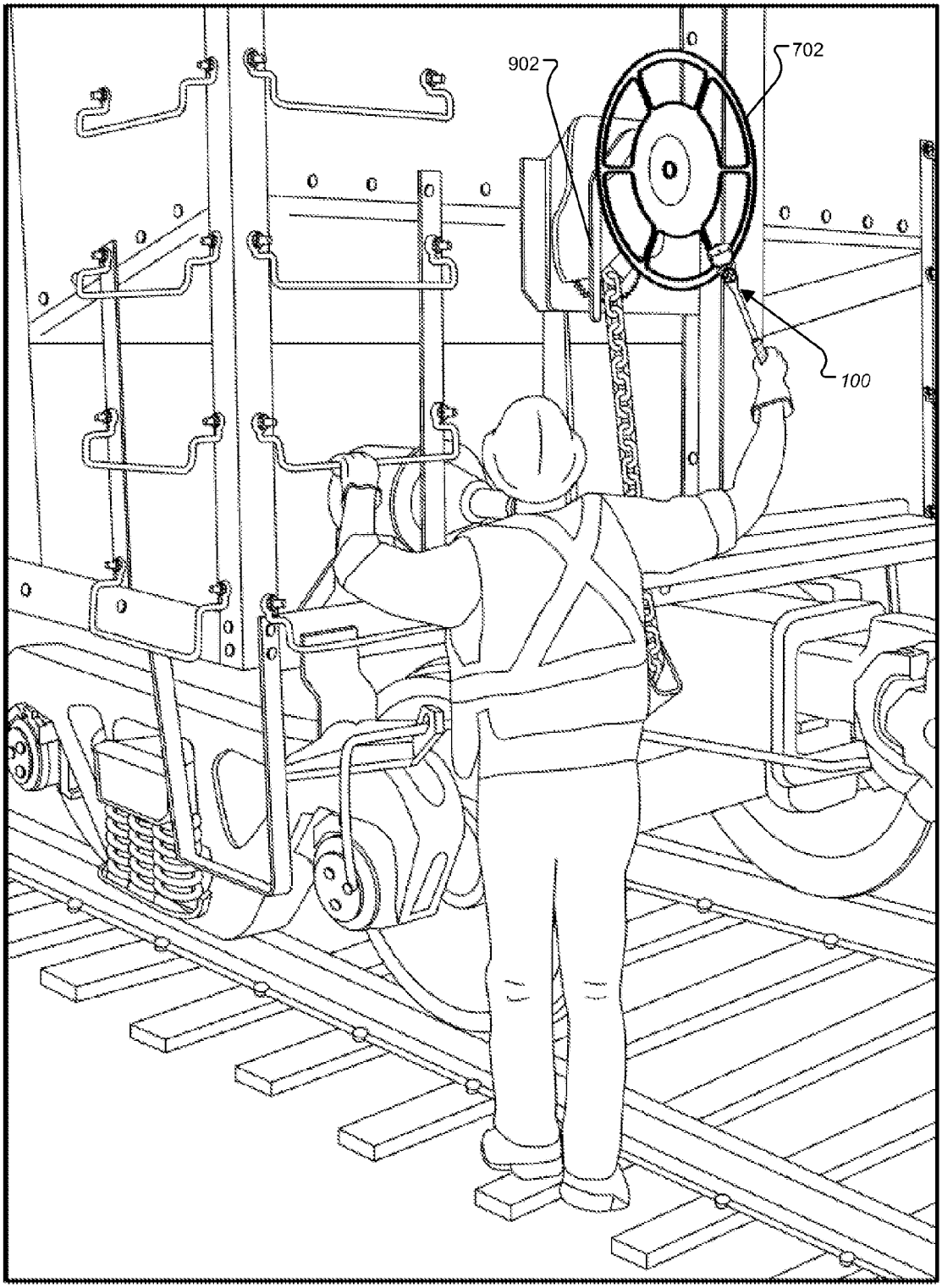
FIG. 13 is a perspective view of the rear of a train car showing an operator turning the handbrake wheel from a safe position using an extension tool according to one embodiment of the invention.

FIG. 13 shows the operation of a handwheel associated with a train car handbrake, in accordance with the present invention. The following steps describe the use of the present invention to apply a handbrake, that is, to place a handbrake in a state that prevents an associated car from moving. The steps of using the tool are as follows:

1. The user should set the desired angle between the tool head 102 and the handle 104. Most users find it easiest to apply the handbrakes when the handle angle is positioned straight in line with the toolhead. However, this angle will vary from person to person, depending on such factors as the person's height, arm length, and personal preference. The angle may also vary depending on whether the user is releasing or applying the handbrakes.
2. The user should place the upper tapered rotating block 114 at the junction of the inside circumference rim and the spoke. The upper surface 118 of lower jaw 116 will not come into contract with the handwheel yet, as shown in FIG. 7B. The position which the toolhead is placed on the handwheel is about the 2:00 o'clock or 3:00 o'clock position.
3. With the tool head 102 held at a slight angle away from the vertical face of the handwheel, the user should pull the tool 100 down and away from the handwheel. When tool head 102 reaches about the 5 to 6 o'clock position, pull the tool 100 away from the handwheel, and the handwheel will continue to spin in a clockwise direction to remove the slack on its handbrake chain. At this point, the user should only pull the tool head with moderate force, since pulling too hard may prevent the tool 100 from being easily removed when it reaches the 5 to 6 o'clock position.
4. if the handwheel does not spin freely because of a defect or other problem, the user should repeat the same step until the slack on the handbrake chain is removed. The user can also allow the tool head 102 to remain in the handwheel past the 6 o'clock position, and follow the handwheel up to about an 8 o'clock position, where tool head 102 will naturally separate from the handwheel.
5. To complete the application of the brake, place the tool head 102 in the handwheel and spoke junction at about the 5 o'clock position. Turn the handle slightly so that the upper surface 118 of lower jaw 116 contacts the outer handwheel rim. This contact will place the tool head 102 and the handle 104 in the same vertical plane as that of the handwheel, as shown in FIG. 7A. With both feet on the ground and one hand on a car grab iron, the user should pull the handle 104 toward himself with a reasonable safe force. This step should be repeated until the handbrake is fully applied; this process typically requires four or five repetitions.

The present invention may be used in a similar way to that described above, in order to release a handbrake. However, the tool would be operated to spin the wheel in the opposite direction from that used to apply the handbrake. In the above example, a user would spin the wheel in the clockwise direction to apply the handbrake and a counter-clockwise direction to release the handbrake. However, this is not limiting and were the directions to be reversed on some handbrakes, the techniques herein may be applied in the opposite direction.

Because of the increased leverage made possible moving the user's hand position further from the handwheel center, the present invention allows the handbrake to be applied much more tightly than it could be applied by hand. In some cases, the present invention may allow the handbrake to be applied tightly enough so that the handbrake cannot be removed without the additional torque provided by tool 100.

Some embodiments of the invention may include a torque limiting device or torque indicating device to prevent over-tightening of the handbrake.

Figure 14:
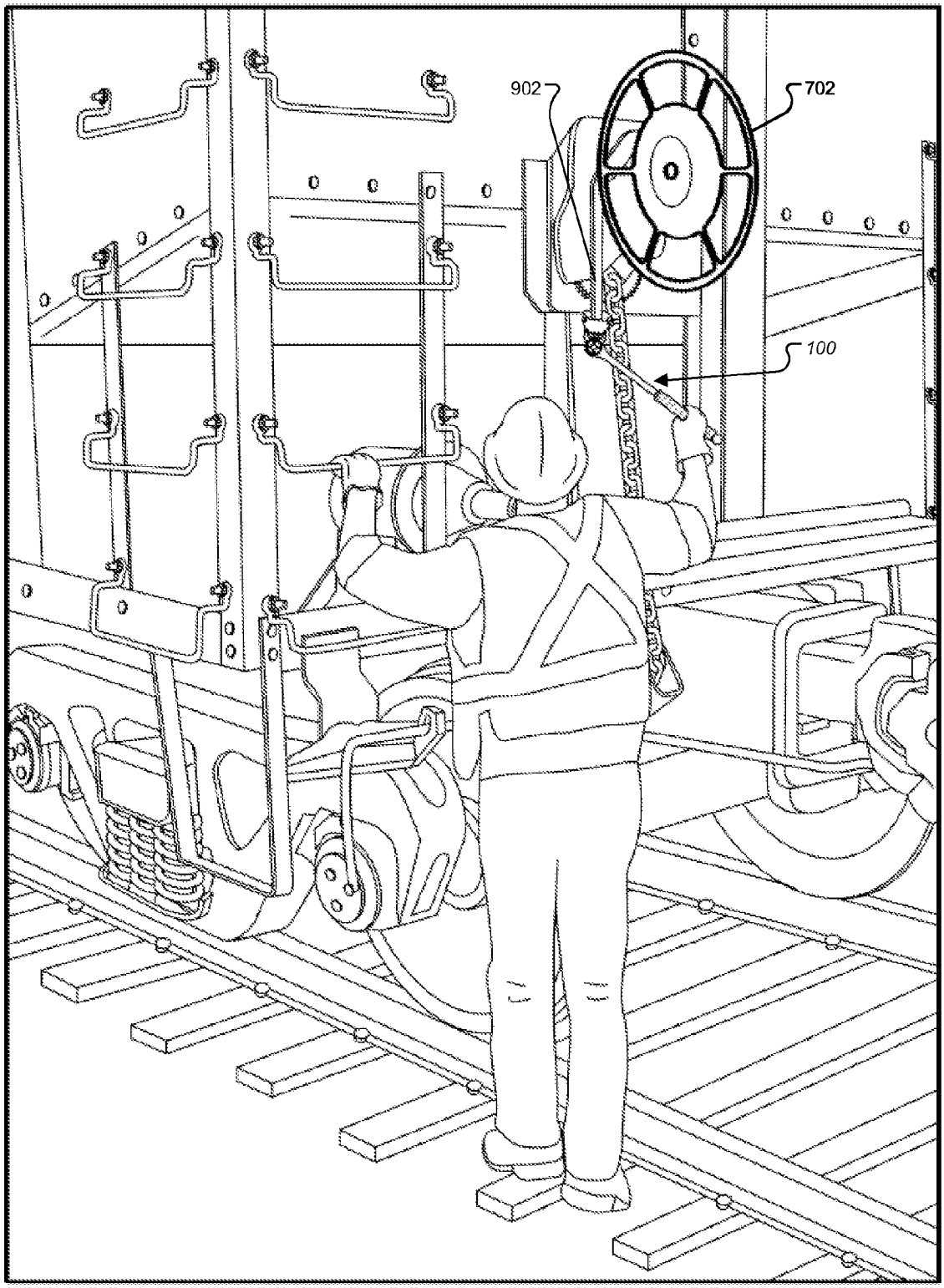
FIG. 14 is a perspective view of the rear of a train car showing an operator activating the quick-release handle with an extension tool according to one embodiment of the invention.

FIG. 14 shows the use of a handbrake to operate a quick release lever associated with a handbrake. A quick release lever is a mechanists on many handbrakes that allows a user to quickly release a handbrake without turning the handwheel. The process of operating quick release lever 902 is the same for both of the above-described embodiments of tool 100, except for the fact that the quick release forks 302 can be removed from the second embodiment and repositioned to allow for larger or smaller quick release levers to fit between them. The steps of operating quick release lever 902 using the present invention are as follows:

1. The user should set the desired proper angle between the tool head 102 and the handle 104. Most users find it easiest to operate the quick release handle when the handle 104 is approximately 45 degrees from the vertical axis of the tool head. Some degree of angular offset between tool head 102 and handle 104 is generally necessary because when a user pushes the quick release lever 902 upward without the angular offset, the quick release lever 902 reaches a point that is too high for most people. However, the exact angle between tool head 102 and handle 104 will vary from person to person.
2. The user should place the quick release forks 302 on the end of quick release lever 902 and push upward so that the handle end contacts stop block 310 and is securely between the quick release forks 302. The end of handle 104 should be facing away from the direction in which the user will move quick release lever 902.
3. With both feet on the ground and one hand on the car grab iron, the user should push handle 104 away from the handbrake and upward until the handbrake chain releases.

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A tool for turning a handwheel, the tool comprising:

a handle;

a tool head connected to the handle, the tool head comprising: (a) a central body with front and back sides and an upper and lower end; (b) an upper jaw extending from the front side of the central body along the upper end, the upper jaw having a lower surface curved and having a graduated lip formed along the curved lower surface, the graduated lip having a first smaller thickness toward the central body and gradually expanding to a second larger thickness away from the central body; (c) a lower jaw extending from the front side of the central body along the lower end;

wherein the upper jaw extends further from the central body than the lower jaw;

wherein a back area of the tool head comprises a recess adapted to receive a quick release lever and allow the tool to be used as an extension tool to operate a quick release lever associated with a railroad car handbrake; and wherein a back area of the tool head comprises two quick release forks that extend from the back side of the tool head, each quick release fork comprising a curved surface, wherein a gap formed between the two curved surfaces accommodates the quick release lever at a plurality of angles between the tool head and the quick release lever.

2. The tool of claim 1, wherein the two quick release forks are both formed from a single machined block.

3. The tool of claim 1, wherein each of the quick release forks is formed from a separate machined block, each quick release block being removable from the tool head and adjustable along a width of the tool head.

4. A tool for turning a handwheel, the tool comprising:

a handle;

a tool head connected to the handle, the tool head comprising: (a) a central body with front and back sides and an upper and lower end; (b) an upper jaw extending from the front side of the central body along the upper end, the upper jaw having a lower surface curved and having a graduated lip formed along the curved lower surface, the graduated lip having a first smaller thickness toward the central body and gradually expanding to a second larger thickness away from the central body; (c) a lower jaw extending from the front side of the central body along the lower end;

wherein the upper jaw extends further from the central body than the lower jaw;

wherein a back area of the tool head comprises a recess adapted to receive a quick release lever and allow the tool to be used as an extension tool to operate a quick release lever associated with a railroad car handbrake; and wherein the graduated lip is part of an upper tapered circular rotating block.

5. A tool for turning a handwheel, the tool comprising a handle;

a tool head connected to the handle, the tool head comprising:

(a) a central body with front and back sides and an upper and lower end;

(b) an upper jaw extending from the front side of the central body along the upper end, the upper jaw adapted to fit an outer curved surface of a handwheel, the upper jaw having a first smaller thickness toward the central body and gradually expanding to a second larger thickness away from the central body; and (c) a lower jaw extending from the front side of the central body along the lower end, wherein the upper jaw extends further from the central body than the lower jaw; and wherein the graduated lip is part of an upper tapered circular rotating block.

6. The tool of claim 5, wherein the upper tapered circular rotating block is adapted to freely rotate around an axis perpendicular to the front side of the tool head.

7. The tool of claim 5, wherein the upper tapered circular rotating block is adapted to fit along both the outward facing curved surface of a handwheel rim and along a joint of the handwheel rim and a spoke of the handwheel.

8. The tool of claim 5, wherein a back area of the tool head comprises two quick release forks that extend from the back side of the tool head, each quick release fork comprising a curved surface, wherein a gap formed between the two curved surfaces accommodates the quick release lever at a plurality of angles between the tool head and the quick release lever.

* * * * *